US011462081B2

(12) United States Patent
Colecchia

(10) Patent No.: US 11,462,081 B2
(45) Date of Patent: Oct. 4, 2022

(54) STORING AND ISSUING MODULE FOR MULTIPLE FLEXIBLE DOCUMENTS

(71) Applicant: ARCA TECHNOLOGIES S.R.L., Bollengo (IT)

(72) Inventor: Enrico Colecchia, Bollengo (IT)

(73) Assignee: ARCA Technologies S.R.L.

( * ) Notice: Subject to any disclaimer, the term of this patent is extended or adjusted under 35 U.S.C. 154(b) by 114 days.

(21) Appl. No.: 16/943,405

(22) Filed: Jul. 30, 2020

(65) Prior Publication Data

US 2022/0036705 A1 Feb. 3, 2022

(51) Int. Cl.
*G07F 19/00* (2006.01)

(52) U.S. Cl.
CPC ..... *G07F 19/203* (2013.01)

(58) Field of Classification Search
CPC ..... G07F 19/203
USPC ..... 221/1
See application file for complete search history.

(56) References Cited

U.S. PATENT DOCUMENTS 9,514,592 B2 12/2016 Michels et al.
2003/0188832 A1* 10/2003 Ripley ..... B32B 37/0053 156/555
2010/0052237 A1* 3/2010 Herczeg ..... G07F 19/20 271/3.16

FOREIGN PATENT DOCUMENTS

EP 3324369 A1 5/2018
WO 2012/164621 A1 12/2012

OTHER PUBLICATIONS

Italy, Search Report and Written Opinion, IT 202000018634, dated Apr. 14, 2021, 8 pages.

* cited by examiner

*Primary Examiner* — Daniel A Hess
(74) *Attorney, Agent, or Firm* — Williams Mullen; F. Michael Sajovec

(57) ABSTRACT

A double storing and issuing device for two banknotes denomination and/or other flexible documents, for use in an equipment for the automatic processing of banknotes, where each storing and issuing device includes a storage roller, relative motor, at least a transport tape provided for wrapping on the storage roller together with the banknotes. The two storage rollers can share the space between them because the transport tape, tensioned by storage roller motor and feeding-roller, pushing against accompanying rollers strictly follows storage roller diameter. The double storing and issuing device includes an electronic unit for the storage roller motors and relative transport tapes revolution sensors, that provides a device full status as any possible combination of storage roller diameter plus a minimum gap to avoid mechanical reciprocal interferences.

33 Claims, 9 Drawing Sheets

STORING AND ISSUING MODULE FOR MULTIPLE FLEXIBLE DOCUMENTS

RELATED APPLICATION

The following application claims priority to (Italian Application No. 102020000018634), filed Jul. 30, 2020, the disclosure of which is incorporated herein in its entirety.

FIELD OF INVENTION

The present invention relates to a multiple storing and issuing module configured to store and issue flexible documents, such as banknotes and paper documents and adapted to be used in a flexible document receiving and dispensing device.

BACKGROUND

Equipment for automatic deposit and withdrawal of banknotes are used not only in banking sites but also in retail sites, as help for tellers or as a customer-operated machine. This kind of equipment includes banknote receipting and dispensing modules for recycling banknotes. Each module is removably mountable within its respective housing so as to allow replacement, wherein each module is provided with a seat associated to a given type of banknotes, which may also be selected depending on the size thereof.

The number of employed housings and modules determines denominations and/or types of banknotes to be handled, as well as dimensions and cost of the equipment. For a large banknote automation market, a very large number of different currencies and denominations have to be considered for these modules as well.

In use, the different denominations or types of banknotes can have very different number of storage and dispensing operations. For instance, 200 Euro and 500 Euro banknotes are generally subject to a limited number of storage and dispensing operations, with small quantities and reduced occupation of the related seat. On the contrary, the module receiving the denominations of banknotes of greater circulation. For instance, seats for 20 Euro and 50 Euro banknotes should satisfy high request of storage and dispensing, which often vary in the time.

The room conventionally provided in an equipment for depositing and withdrawing banknotes is used in a non-optimal way. Moreover, the module for the banknotes of greater circulation can easily reach the conditions of full or empty module, thereby limiting functionality of the equipment. On the other hand, the addition of housing for the modules for storing banknotes with greater circulation is expensive and not efficient for storage room dimensioning.

Banknote processing equipment that use combinations of modules with different capacities, one for greater circulation banknote and one for reduced circulation banknotes can help to increase the modules real filling only if the statistical circulation of the selected banknotes match with the modules capacity composition. However, due to very large variations of circulation statistic percentages between different denominations, currencies and applications type, these solutions cannot be efficient in term of storage rollers filling for all possible applications.

Thus, there remains a need for a dynamic, more reliable and efficient way to store banknotes of different denominations.

SUMMARY

It is an object of this invention, therefore, to allow in a dynamic, reliable, and efficient way, to store flexible documents, such as banknote, so as to dynamically adapt the storage capacity to the actual number of deposited and withdrawn banknotes in a receiving and dispensing device. Accordingly, one aspect of the invention is directed to a multiple storing and issuing module for flexible documents of different types. For example, the flexible documents may be banknotes of differing denominations.

In one embodiment, the multiple storing and issuing module includes a first storage roller configured to store a first type of flexible document and a second storage roller configured to store a second type of flexible document. The storage rollers share a common space within the module for storing flexible documents. Each storage roller has a sensor for monitoring a storage capacity of the storage roller. In this embodiment, the module further includes an electronic unit having a memory storage and microprocessor that is configured to maintain a minimum gap between the storage rollers. The minimum gap may be determined by a diameter defined as a distance between a center of the storage roller and the companion rollers. The storage capacities of each storage roller have an adjustable maximum capacity based on maintaining a gap between the storage rollers greater than or equal to the minimum gap. In some embodiments, the first storage roller and the second storage roller may be substantially vertically arranged within the common space.

In some embodiments, each storage roller may include a motor configured to rotate the storage roller, at least one transport tape configured to wrap the flexible document onto or off the transport tape and a feeding roller configured to wind the transport tape in a desired direction. In some embodiments, the multiple storing and issuing module may further include a set of pinch rollers for each storage roller that are configured to engage and disengage the flexible document with the storage roller, and may also include an electromagnet for each set of pinch rollers for determining a pressure between the pinch rollers for engagement and disengagement with the storage roller. In such configurations, the pinch rollers press onto transport tape and the storage roller at an increased pressure for engagement and the pinch rollers release from the transport tape and the storage roller for disengagement.

The sensor may be a revolution sensor configured to monitor storage capacity by relating each revolution of one of the pinch rollers to a storage roller revolution angle, whereby the revolutions are correlated to an amount of flexible documents stored on the storage roller.

In some embodiments, each storage roller may include a pair of companion rollers, whereby at least one of the pair of companion rollers is configured to follow a trajectory along one or more side grooves for maintaining the minimum gap. At least one of the storage rollers may be configured to move along one or more collars on a side plate. For example, the pair of companion rollers for one of the storage rollers may be installed in a fixed position on the side plate. The multiple storing and issuing module may further include a spring to connect the pair of rollers in the fixed position with its storage roller. The multiple storing and issuing module may also further include a belt tensioner pulley assembly for each storage roller enabling its storage roller to move along the collar on the side plate. In some embodiments, one or more additional actuators configured to maintain spacing between the storage rollers and a surface of the storing and issuing module may be included.

Some embodiments of the multiple storing and issuing module may include a set of accompanying rollers outside the common space for each storage roller that are positioned at a maximum distance that the storage rollers can travel outside the common space. The set of accompanying rollers are configured to prevent the storage roller from traveling past the maximum distance.

In some embodiments, the module may further include an upper lever arm with an actuatable pinch roller configured to facilitate separation of the banknote from the transport tape, and a lower lever arm with one of the companion rollers at an end of the lower lever arm, wherein the lower lever arm configured to guide the banknotes between the storage roller and the diverter.

Another aspect of the invention is directed to a banknote receiving and dispensing device with storage rollers each having an adjustable maximum capacity for storing banknotes. The receiving and dispensing device includes an upper body assembly for receiving and dispensing banknotes, and a lower body assembly for storing banknotes. The lower body assembly comprises a safe having a plurality of lodgments and a transport mechanism for storing and issuing banknotes. One or more of the lodgments each include a double storing and issuing module with two storage rollers each having an adjustable maximum capacity for storing banknotes.

In some embodiments, each double storing and issuing module has a first storage roller configured to store a first denomination of a banknote and a second storage roller configured to store a second denomination of a banknote. Each storage roller has a sensor for monitoring a storage capacity of the storage roller. A common space within the module is shared by the first and second storage rollers for storing banknotes. The module further includes an electronic unit with a memory storage and microprocessor that is configured to maintain a minimum gap between the storage rollers. The storage capacities of each storage roller have an adjustable maximum capacity based on maintaining a gap between the storage rollers greater than or equal to the minimum gap.

In some embodiments of the banknote receiving and dispensing device, each storage roller may include a motor configured to rotate the storage roller, at least one transport tape configured to wrap the flexible document onto or off the transport tape and a feeding roller configured to wind the transport tape in a desired direction. In some embodiments, the multiple storing and issuing module may further include a set of pinch rollers for each storage roller that are configured to engage and disengage the flexible document with the storage roller, and may also include an electromagnet for each set of pinch rollers for determining a pressure between the pinch rollers for engagement and disengagement with the storage roller. In such configurations, the pinch rollers press onto transport tape and the storage roller at an increased pressure for engagement and the pinch rollers release from the transport tape and the storage roller for disengagement. Each storage roller may further include a pair of companion rollers configured to follow a trajectory for maintaining the minimum gap.

The receiving and dispensing device may further include a plurality of diverters configured to distribute banknotes to the storage roller based on a denomination of the banknote and an electromagnet for each diverter configured to actuate the diverter and enable the banknote to enter or exit a path of the storage roller. The receiving and dispensing device may also include a photoelectric sensor configured to detect the presence of the banknote entering from the diverter. In some embodiments, the electronic unit may be configured to manage the entry and exit of banknotes onto and off the storage rollers by controlling the activation of the motors, the electromagnets of the pinch rollers and the electromagnets of the diverters.

In some embodiments, the receiving and dispensing device may include a recognition unit configured to determine a denomination of banknotes entering the input vane. A capture bin may be included that is configured to store undeliverable banknotes. An electronic control unit in communication with the electronic unit may be included for assigning banknotes to a storage roller or the capture bin. Some embodiments of the receiving and dispensing device may include an input vane configured to receive banknotes and an output vane configured to dispense banknotes.

Another aspect of the invention is directed to a method for managing storage capacities for a first storage roller and a second storage roller sharing a common space within a storing and issuing module. The method includes adjusting a storage capacity of the first storage roller and a storage capacity of the second storage roller in real-time while maintaining at least a minimum gap between the first storage roller and the second storage roller. The diameters for a first storage roller and a diameter of a second storage roller may be monitored to ensure that the minimum gap is maintained. In some embodiments, the first storage roller and the second storage roller may be substantially vertically adjacent within the common space.

In some embodiments, the method may further include the steps of identifying a denomination of a banknote received and assigning a storage roller to store the banknote based on its denomination. The storage capacities may be adjusted in real-time based on a number of banknotes and a number of denominations corresponding to the banknotes received. For example, the storage capacities maybe adjusted by an electronic unit having a microprocessor and a memory storage device.

Another aspect of the present invention is directed to a double storing and issuing module for banknotes recycling, with two storage rollers and transport tape technology, configured to adapt the storage capacity of each roller to the real number of deposited and withdrawn banknotes used in a receiving and dispensing device that can include one or more of these modules.

The module includes two storage rollers and relative transport tapes each configured to store flexible documents, in particular banknotes, generally in the sense of shorter dimension of the flexible document (even if this is not an essential feature), together with the related transport tape, according to an arrangement wherein the two storage rollers share a common space interposed therebetween (usually, along a vertical direction when the receiving and dispensing device including the module is put in operation).

Another aspect is to avoid any part lying in the common space shared by and interposed between the two storage rollers and let each one of them increase in size towards the other storage roller.

To assure that, an innovative layout, based on a prefixed trajectory of two accompanying rollers, causes the tape-forward path of at least one of the two storage roller (namely the top one), along which the transport tape moving from the storage roller to a related feeding roller, to strictly follow the top storage roller diameter without taking up useful space between the two storage rollers.

In some embodiments, each accompanying-rollers shaft has its ends guided by side grooves, and the transport tape's tension pushes it against the storage roller.

The side grooves trajectory, function of diameters of storage and accompanying rollers, assures an anti-friction minimal gap between each storage roller and the tape forward path.

Another aspect of the of invention is directed to a control-algorithm that, relatedly to stepper motors motion and transport-tape revolution sensors, provides an accurate module full status for any possible combination of both storage roller diameters.

BRIEF DESCRIPTION OF THE DRAWINGS

The present invention will be now described, by way of illustration and not by way of limitation, according to its preferred embodiments, by particularly referring to the Figures of the attached drawings, in which.

DETAILED DESCRIPTION OF THE PREFERRED EMBODIMENTS

In the following of the present description, reference will be mainly made to banknotes as flexible documents. However, it should be noted that the multiple storing and issuing module, and related flexible document receiving and dispensing device, may be applied to store and issue any other type of flexible documents, including paper documents such as checks, notes, certificates and licenses, still remaining within the scope of protection of the present invention defined by the attached claims.

Figure 1:
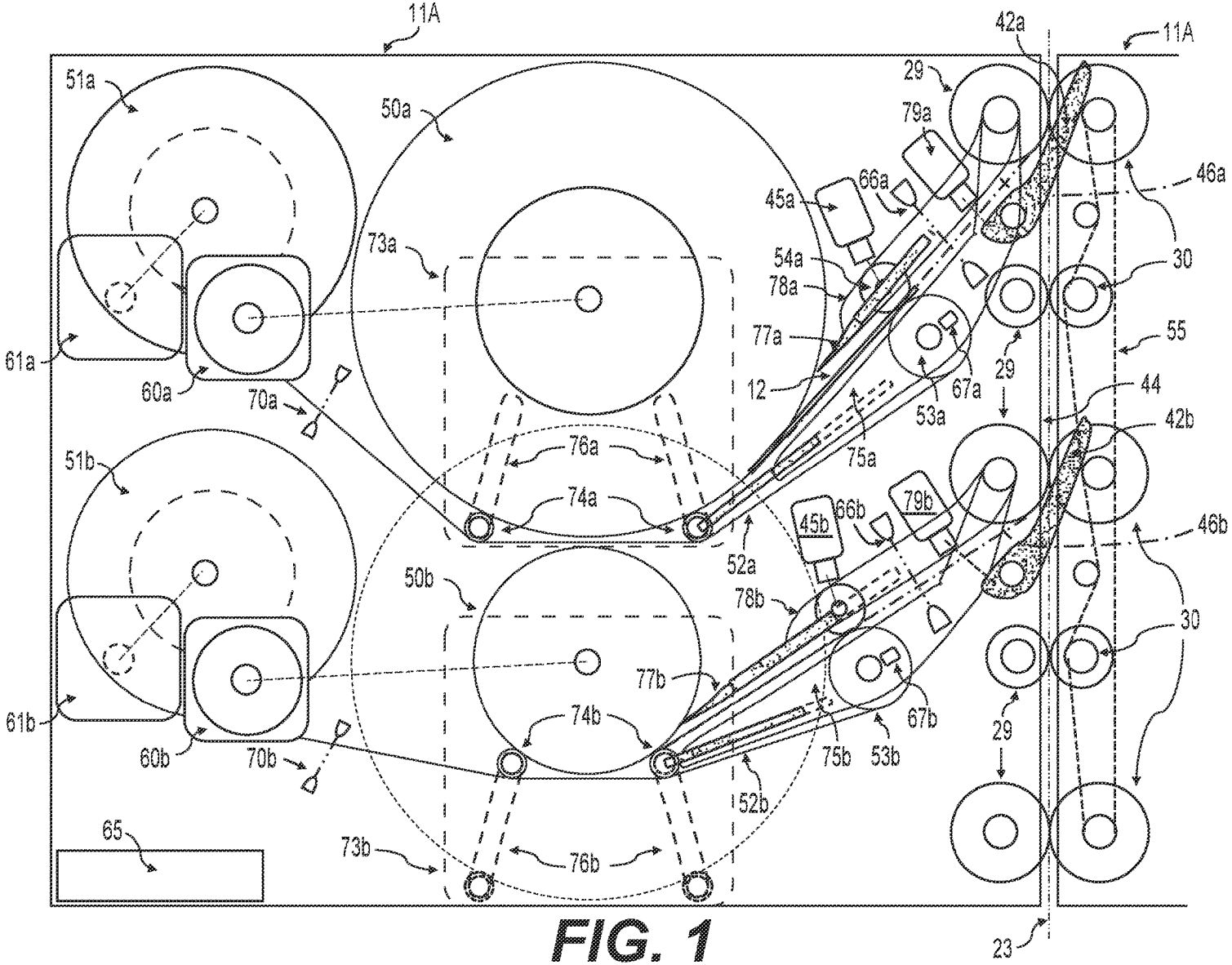
FIG. 1 shows a schematic view of one embodiment of a double storing and issuing module for banknotes or other flexible documents.

A double storing and issuing module according to one embodiment, indicated with the reference numeral 11A configured to store and issue dual denomination banknotes 12 or other flexible documents is illustrated as an example and in schematic way in FIG. 1. The double storing and issuing module 11A has two similar sections in each one of which a pair of accompanying rollers 74*a* or 74*b* follows an external surface of a respective storage roller 50*a* or 50*b* adapting to the instant diameter thereof.

Figure 2:
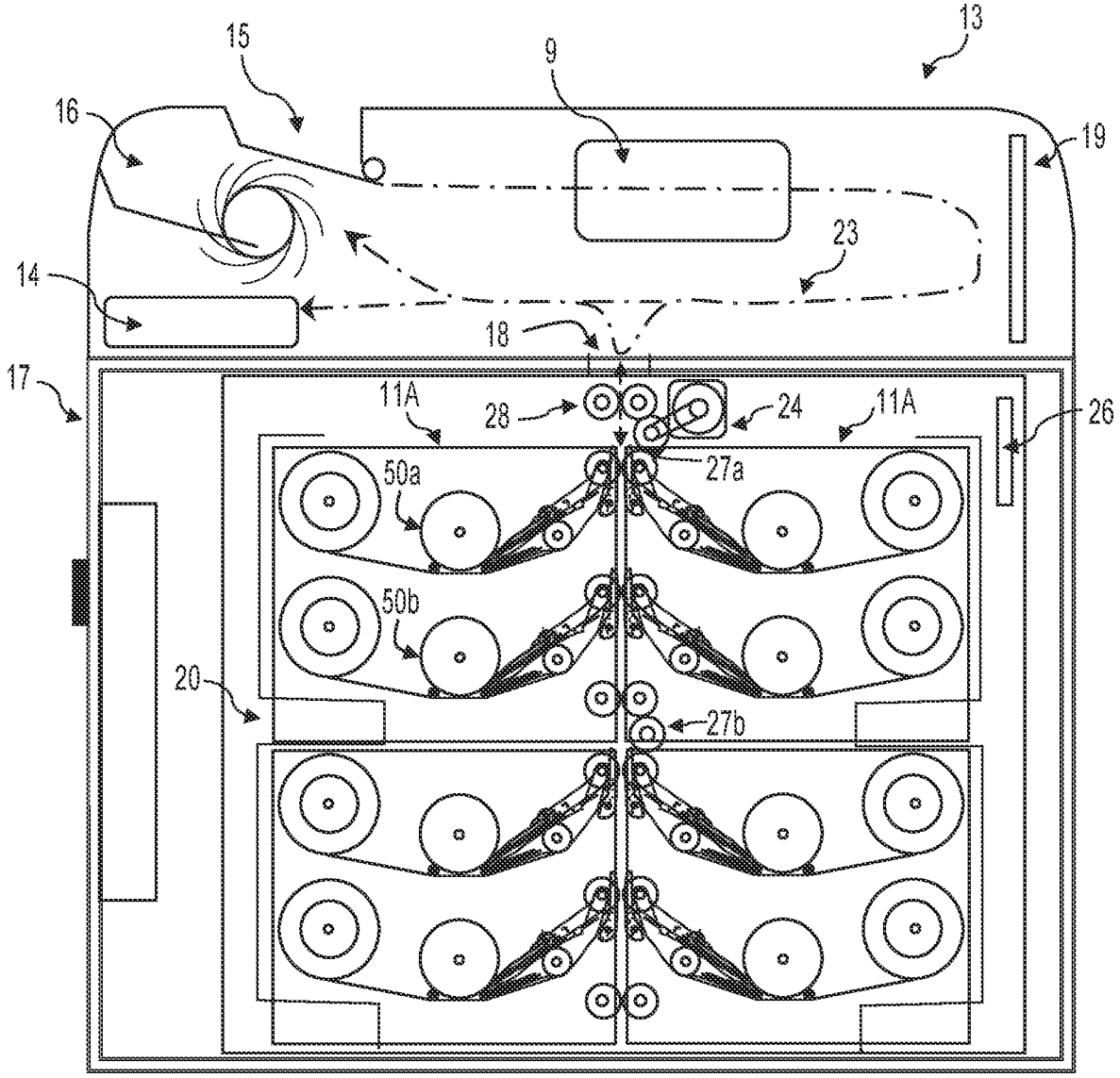
FIG. 2 shows a schematic view of one embodiment of the flexible document receiving and dispensing device, which use a plurality of the modules of FIG. 1.

FIG. 2 shows a schematic view of an embodiment of the flexible document receiving and dispensing device, indicated with the reference numeral 13, using a plurality of double storing and issuing modules 11A for the automation of cash activities. The receiving and dispensing device 13 comprises an upper body for the acquisition and issuing of banknotes or other flexible documents and a lower body for the deposit of the banknotes or other flexible documents and which constitutes a safe 17, in reciprocal communication through an opening 18.

As already mentioned, the receiving and dispensing device 13 and the double storing and issuing module 11A can process flexible documents other than banknotes; for example, checks, certificates, licenses and notes, and other flexible documents of which the dimensional characteristics are known.

The upper body of the receiving and dispensing device 13 includes an input vane 15 where banknotes can be introduced, an output vane 16 from where banknotes are issued, a capture bin 14 configured to store undeliverable banknotes, a main electronic control unit 19 and other conventional mechanisms (not shown in the drawings) to move the banknotes between the vane 15 or 16 and the opening 18 or the bin 14.

The safe 17 includes a structure 20 with a plurality of housings, a transport mechanism controlled by a transport electronic unit 26, communicating with the main electronic control unit 19, configured to further move the banknotes. Each housing of the structure 20 can accommodate a respective double storing and issuing module 11A for storing and issuing two banknote denominations by means of two storage rollers 50*a* and 50*b*. As the two storage rollers 50*a* and 50*b* included in each double storing and issuing module 11A can have identical mechanical structure, the main electronic control unit 19 can also assign the denominations of banknotes to any one of the storage rollers 50*a* and 50*b* according with the capacity flexibility of the double storing and issuing module 11A as described herein.

In an acquisition mode of the receiving and dispensing device 13, the banknotes are taken from the input vane 15, validated by a recognition-unit 9 and distributed between the storage rollers 50*a* and 50*b* included in double storing and issuing modules 11A on the basis of the denominations. In an issuing mode, the banknotes are moved from storage rollers 50*a* and 50*b* towards the output vane 16.

FIG. 2 shows one example of a lower structure 20 composed of two front double storing and issuing modules 11A (shown at the left-hand side of FIG. 2) and two rear double storing and issuing modules 11A (shown at the right-hand side of FIG. 2. Different arrangements are possible in other embodiments; for example, by placing two double storing and issuing modules 11A opposed to each other or having a transport mechanism with an interface zone 44 (as shown in FIG. 1) to provide a banknote transport path 23 aligned with the opening 18.

The lower structure 20 is also provided with guides, configured to remove the double storing and issuing modules 11A from their housings, and blocks, configured to keep the modules in their own operating positions (not shown in the drawings).

The lower structure 20 includes a transport mechanism composed of a stepper motor 24 and a transmission belt up to a higher transmission gear 27*a* associated to the stepper motor 24. The higher transmission gear 27*a* transmits motion to a pair of transport rollers 28 adjacent to the opening 18, and to the highest rear double storing and issuing module 11A. Each rear double storing and issuing module 11A transmits motion to all of its own transmission rollers 30 by means of a side toothed belt 55 (as shown in FIG. 1). A lower transmission gear 27*b* is provided on the lower section of the lower structure 20 so as to propagate motion to the lowest rear double storing and issuing module 11A.

Consequently, each front double storing and issuing module 11A provided with free-rollers 29 can easily become a rear double storing and issuing module 11A by adding a toothed side belt (similar to the one indicated with reference numeral 55 in FIG. 1).

With reference to both FIGS. 1 and 2, in acquisition mode, the receiving and dispensing device 13 moves the banknotes downwards through the opening 18 of the safe 17, with clockwise rotation of the stepper motor 24 and transmission gears 27*a* and 27*b*, counterclockwise rotation of the transmission rollers 30 of the rear double storing and issuing modules 11A and clockwise rotation of the free rollers 29 of the opposite front double storing and issuing modules 11A. The receiving and dispensing device 13 recognizes the denominations of the banknotes and positions the diverters 42*a* and 42*b* of each double storing and issuing module 11A to selectively distribute and store the banknotes in various sections of the front and rear double storing and issuing modules 11A on the basis of the associated denominations. The banknotes emerge from the opening 18 at relatively high speed spaced from each other allowing the diverters 42*a* and 42*b* (under control of respective electromagnets 79*a* and 79*b*) to deviate, on the fly, a banknote in transit, without interference with a preceding or following banknote.

In issuing mode, the receiving and dispensing device 13 moves the banknotes upwards through the opening 18 of the safe 17, with counterclockwise rotation of the stepper motor 24 and transmission gears 27*a* and 27*b*, clockwise rotation of the transmission rollers 30 of the rear double storing and issuing modules 11A and counterclockwise rotation of the free rollers 29 of the opposite front double storing and issuing modules 11A. Then the double storing and issuing module 11A containing the section with requested banknote denomination actuates electromagnet 45*a* or 45*b* and through its diverter 42*a* or 42*b* allows the related storage roller 50*a* or 50*b* to issue the stored banknotes through its internal entry-exit path 46*a* or 46*b*.

Making reference to FIG. 1, the double storing and issuing module 11A, that is configured to store and then issue double banknote denominations with flexible capacity, consists of two functionally similar overlapping sections for storage and issuing in which similar components are indicated in FIG. 1 with reference numerals having the suffix "a" for the upper (or top) section and "b" for the lower (or bottom) section.

The upper section for storage and issuing includes a top storage roller 50*a* configured to store a first type of banknotes 12, a top feeding-roller 51*a*, at least one top transport-tape 52*a* and top holding means actuatable for engaging a banknote 12 with the top transport-tape 52*a*. In detail, the top holding means includes a pair of top pinch-rollers 53*a* and 54*a* configured to mutually shift under control of a top electromagnet 45*a*. Top motors 60*a* and 61*a* are configured to cause the top storage roller 50*a* and top feeding-roller 51*a*, respectively, to rotate.

In turn, the top pinch-rollers 53*a* and 54*a* are arranged, respectively, below and above the top entry-exit path 46*a*, at the side of the top storage roller 50*a*. The top motors 60*a* and 61*a* may be conventional stepper motors, controlled as open-loop servomechanisms, which rotate the top storage feeding rollers 50*a* and 51*a* through proper pulleys and toothed transmission belts (not shown in the drawings).

The top transport-tape 52*a* is configured to wrap and carry out between the top storage roller 50*a* and feeding-roller 51*a* and cooperates with the first top pinch-roller 53*a* configured to act as a return roller. The top transport-tape 52*a* is made of high resistance thin transparent plastic (for instance, mylar) and may include one tape for banknote long-edge direction or two tapes arranged side by side for banknote short-edge direction. The top storage roller 50*a* is configured to store in spool the banknotes 12 together with the top transport-tape 52*a*. The top pinch-roller 53*a* and 54*a* are offset arranged along the top entry-exit path 46*a* included between the interface area 44 and the top storage roller 50*a*.

Therefore the path for each banknote 12 in the upper section of the double storing and issuing module 11A has a first portion, included between the interface zone 44 and the top pinch-rollers 53*a* and 54*a*, limited by the top diverter 42*a*, and a second portion, between the top pinch-rollers 53*a* and 54*a* and the top storage roller 50*a*, limited by the top transport-tape 52*a*.

The top pinch-rollers 53*a* and 54*a* are configured to mutually shift, under control of the top electromagnet 45*a*, between an engagement configuration at which they can drag the banknotes 12 and a disengagement configuration at which they are spaced apart from each other. The second top pinch-roller 54*a* has function of pressing member and is supported by a bridge (not shown in the drawings), which is urged by a spring (not shown in the drawings) towards the first top pinch-roller 53*a*. The top electromagnet 45*a*, when de-energized, determines the engagement configuration with engagement by pressure between the top pinch-rollers 53*a* and 54*a*. When energized, the top electromagnet 45*a* determines the disengagement configuration with the second top pinch-roller 54*a* spaced apart from the first top pinch-roller 53*a*.

In the engagement configuration, the second top pinch-roller 54*a* presses on the top transport-tape 52*a* supported by a portion of the first top pinch-roller 53*a* so as to drag, by adherence, the banknote 12 interposed between the top transport-tape 52*a* and the second top pinch-roller 54*a*. In the disengagement configuration, a banknote 12 can slide with low friction on the top transport-tape 52*a*, underneath the second top pinch-roller 54*a*.

A top photoelectric sensor 66*a* is configured to detect the presence of the banknote 12 in the portion of the top entry-exit path 46*a* between the top diverter 42*a* and the top pinch-rollers 53*a* and 54*a*, while an electronic unit 65 of the double storing and issuing module 11A controls the activation of the top motors 60*a* and 61*a* and of the top electromagnets 45*a* and 79*a*. A top tape sensor 70*a* is configured to recognize the passage of end portions of the top transport-tape 52*a*, providing a state associated with a condition of empty storage roller 50*a* or terminated feeding-roller 51*a*. A top revolution sensor 67*a* is associated to the first top pinch-roller 53*a* and it is configured to detect revolutions of the first top pinch-roller 53*a*, on the basis of which, by means of an algorithm that relates each first top pinch-roller 53*a* revolution to the rotation angle of the top stepper motor 60*a*, the electronic unit 65 is configured to obtain the diameter of the storage roller 50*a* and, processing the diameters of both top and bottom storage rollers 50*a* and 50*b*, to output a state of section or module full.

The upper section of the double storing and issuing module 11A further includes a top pair of accompanying-rollers 74*a*, each one guided by a respective top side grooves 76*a* of a respective top side plates 73*a* along a predefined trajectory. A lower lever arm 75*a* and an upper lever arm 78*a* of the upper section, both pivoted on the axis of the input free-roller 29, are configured to guide the banknote 12 along the path between the top diverter 42*a* and the storage roller 50*a*.

The lower lever arm 75*a* of the upper section has a spring (not shown in the drawings) that pushes it upwards so that one of the top accompanying rollers 74*a*, that is rotatably connected to the extendable end of the lower lever arm 75*a*, follows, on a defined trajectory of side grooves 76*a*, the external diameter of the storage roller 50*a*, causing the length of the lower lever arm 75*a* to adapt accordingly. The first top pinch-roller 53*a*, around which the top transport-tape 52*a* wraps, is rotatably connected to the lower lever arm 75*a*, substantially at half-length thereof; the top transport-tape 52*a* also move along a top tape forward path between the top feeding-roller 51*a* and the top entry-exit path 46*a*, wherein the top tape forward path is located in the common space shared by and interposed between the top and bottom storage rollers 50*a* and 50*b*. Both axes of the top accompanying rollers 74*a* have ends guided by corresponding top side-groves 76*a*, symmetrically located with respect to the axis joining the axes of the top and bottom storage rollers 50*a* and 50*b* to assure a path spaced apart from the external diameter of the top storage roller 50*a* by a minimum anti-friction space.

During operation, the top pair of accompanying rollers 74*a* are pushed by the top transport-tape 52*a* along said top tape forward path against the external surface of the first storage roller 50*a*, wherein both top accompanying rollers 74*a* have axes following a respective trajectory to maintain a first anti-friction gap between said top tape forward path and said external surface of the top storage roller 50*a*, i.e. between the top first transport-tape 52*a* and said external surface of the top storage roller 50*a*. In other words, said top tape forward path dynamically adapt around the dynamically variable instant size of the top storage roller 50*a*.

The second top pinch-roller 54*a*, operated by the top electromagnet 45*a*, is rotatably connected to the upper lever arm 78*a* of the upper section, that is pushed by a spring (not shown in the drawings) towards the lower lever arm 75*a*. The upper lever arm 78*a* includes a housing for a compression spring (not shown in the drawings) and an extensible plastic blade 77*a* that, following the external surface of the top storage roller 50*a*, facilitates the separation of the banknotes 12 from the wrapped top transport-tape 52*a*.

Figure 3:
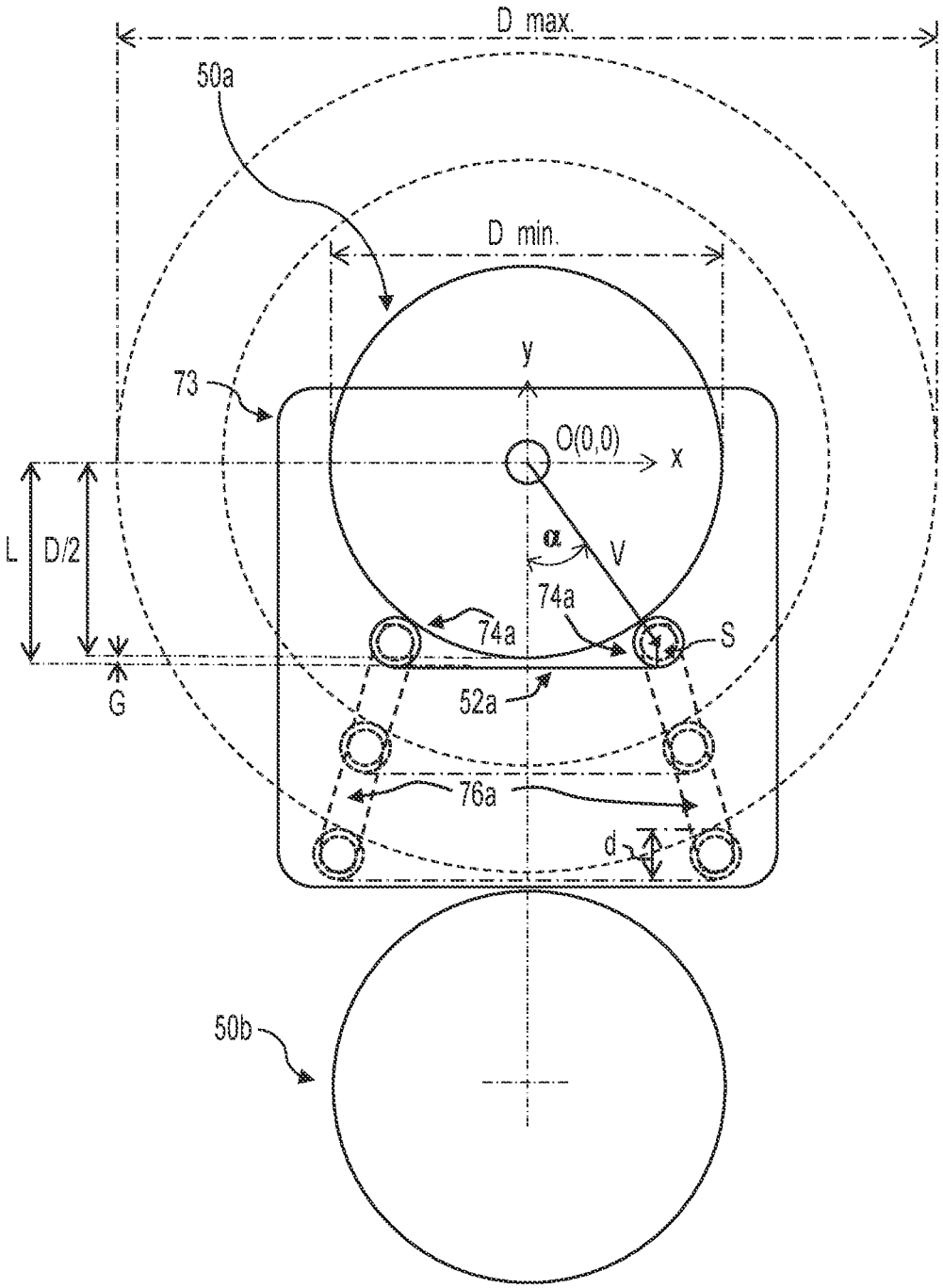
FIG. 3 shows a simplified geometric view of the double storing and issuing module of FIG. 1.

FIG. 3 shows a simplified geometric view of the arrangement according to which the top transport-tape 52*a*, along said top tape forward path, strictly follows the instant diameter D of the top storage roller 50*a* plus a first anti-friction gap also avoiding to occupy the common space shared by the top and bottom storage-rollers 50*a* and 50*b*, wherein said top tape forward path is orthogonal to the axis y between the centers of the top and bottom storage-rollers 50*a* and 50*b*. For this purpose, the two symmetrical top accompanying rollers 74*a*, following a predetermined trajectory guided by the two respective top side grooves 76*a*, leave a minimum anti-friction gap G.

To calculate the path of one of the top accompanying rollers 74*a*, upon variation of the instant diameter D of the top storage roller 50*a* from a minimum diameter Dmin to a maximum diameter Dmax, by considering the center of the top storage roller 50*a* as origin O(0,0), the distance L of the top tape forward path (i.e. the distance of the top transport-tape 52*a*) from the origin O(0,0) is given by $$L = \frac{D}{2} + G$$

That is, by using the projections on the axis y of both the radius S of one of the top accompanying rollers 74*a*, having diameter d, and radius V joining the origin O(0,0) with the point of contact of the top accompanying roller 74*a* with the top storage roller 50*a*, is also given by $$L = \frac{d}{2} + \frac{d+D}{2}\cos\alpha$$

wherein α is the angular distance of the radius V from the axis y. This angular distance is a function of the diameter D of the top storage roller 50*a*, thereby:

$$\alpha_{(D)} = \arccos\left(\frac{2L-d}{D+d}\right)$$

that can be expressed in relation to the first anti-friction gap G:

$$\alpha_{(D)} = \arccos\left(\frac{D-d+2G}{D+d}\right)$$

Thus, coordinates $x_{(D)}$ and $y_{(D)}$ of one of the top accompanying rollers 74*a* as a function of diameter D of the top storage roller 50*a*, i.e. coordinates $x_{(D)}$ and $y_{(D)}$ of the trajectory followed by such top accompanying roller 74*a* as a function of diameter D of the top storage roller 50*a*, are as follows:

$$\begin{cases} x_{(D)} = \frac{(d+D)}{2} * \sin\alpha_{(D)} \\ y_{(D)} = -\frac{(d+D)}{2} * \cos\alpha_{(D)} \end{cases}$$

The trajectories of the two top accompanying rollers 74*a* are symmetrical to each other with respect to the vertical axis y. The top side grooves 76*a* in FIG. 1 then guide the top accompanying rollers 74*a* using the thus calculated trajectory.

In the layout example of FIG. 1, only said top tape forward path followed by the top transport-tape 52*a* of the upper section needs to follow the diameter of the related storage roller (namely, the top storage roller 50*a*). Nevertheless, the first embodiment of the double storing and issuing module, applies the same arrangement also to the lower section, thus allowing the use of the same components for the two sections.

Figure 4:
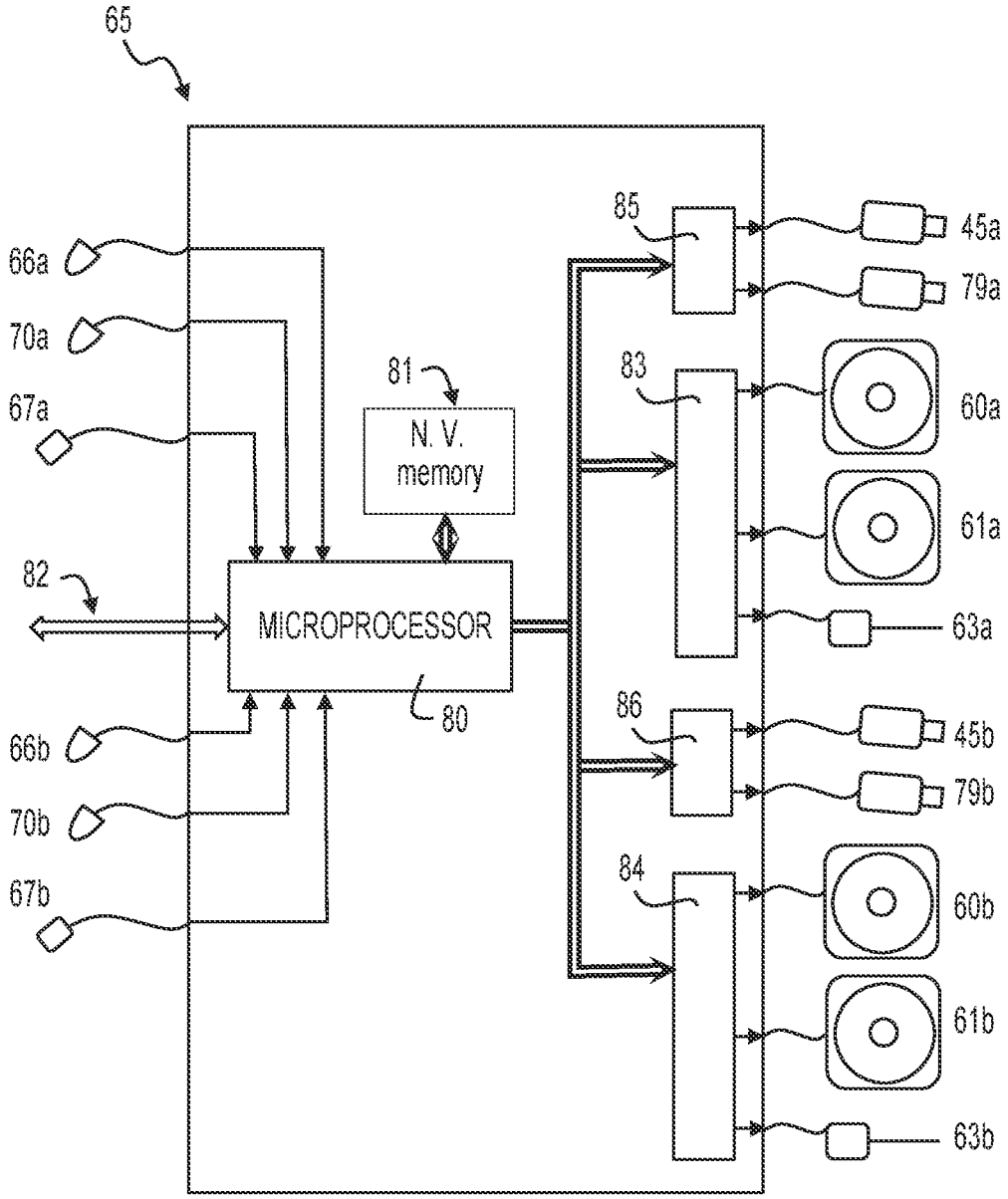
FIG. 4 shows an electrical block diagram of the electronic and electromechanical components of the double storing and issuing module of FIG. 1.

With reference to FIG. 4, immediately comprehensible by those skilled in the art, the electronic unit 65 of the double storing and issuing module 11A includes a high speed computing microprocessor 80 the inputs of which are connected to sensors 66*a*, 67*a*, 70*a*, 66*b*, 67*b*, 70*b*, that is further connected to a communication-line 82 and, through first driving circuits 83, 84, to the motors 60*a*, 61*a*, 63*a*, 60*b*, 61*b*, 63*b* and, through second driving circuits 85, 86, to the electromagnets 45*a*, 79*a*, 45*b*, 79*b*.

The electronic unit 65 is configured to control both upper and lower section of the double storing and issuing module 11A for storing and issuing banknote without space between them according to the process disclosed in document EP2104638. Additionally, the electronic unit 65 calculates with good accuracy on the basis of data received from the two revolutions sensors 67*a* and 67*b*, the full status of the double storing and issuing module 11A as any combination of the diameters of the top and bottom storage rollers 53*a* and 53*b*. A non-volatile memory 81 stores settings and working data during the life of the double storing and issuing module 11A.

The mechanical layout of the double storing and issuing module 11A according to embodiments of the invention, wherein a common space within the double storing and issuing module 11A is shared by and interposed between the top and bottom storage rollers 50*a* and 50*b*. In this regard, it is necessary to sense when the combination of the top and bottom storage rollers 50*a* and 50*b* fill the entire common space.

To avoid a differential diameter physical sensors or two rotational encoder, an innovative robust process availing of top and bottom inexpensive revolution (optionally magnetic) sensors 67*a* and 67*b* has been developed.

The following description, referred to the top storage roller 53*a*, is valid for the bottom storage roller 53*b*.

As shown in FIG. 1, the outer diameter of the storage roller 50*a* (varying as a function of the wrapped length of the top transport-tape 52*a*) follows the first top pinch-roller 53*a* (that may advantageously be a rubber gripping one) for about 180 degrees, ensuring, with adequate tape tensioning, a reliable relation of the top revolution sensor 67*a* with the movement of the top transport tape 52*a*. To obtain at least two measurement for each incoming banknote, starting from any position of the first top pinch-roller 53*a*, the perimeter (i.e. the circumference) of the first top pinch-roller 53*a* is lower than the minimum banknote length and three magnets (not shown in the drawings) are equally spaced on the circumference of the first top pinch-roller 53*a*.

The instant diameter Da of the top storage-roller 50*a* can be estimated by measuring the number Ma of steps of the top stepper motor 60*a* needed to cause a point on the external circumference of the top storage-roller 50*a* to describe a pre-determined length equal to a pre-determined length described by a point on the circumference of the first top pinch-roller 53*a*. This can be expressed in terms of amount of full revolutions of the first top pinch-roller 53*a*. In other words, assuming that the number of steps per full revolution of the top stepper motor 60*a* is N and that K is the amount of full revolutions of the first top pinch-roller 53*a*, then the instant diameter Da of the top storage-roller 50*a* can be estimated as follows:

$$Da=(K*Dg*R*N)/Ma$$

wherein:

Dg is the diameter of the first top pinch-roller 53*a;*

Ma is the measured number of steps of the top stepper motor 60*a* needed to cause the first top pinch-roller 53*a* to make K full revolutions; and R is the transmission-ratio from the top storage-roller 50*a* to the top stepper motor 60*a*.

In general, K is correlated to the number of magnets located on the circumference of the first top pinch-roller 53*a* and, by using a specific number of these magnets, K can be any real number; more usually, K is a rational number. In particular, the number of magnets is advantageously correlated to the minimum banknote length.

The value of the instant diameter Da is updated at each detection of a magnet by the top revolution sensor 67*a*, and it is given by the average of a number of measurements (including the last measurement and previous ones) where this number is given by the number of detections by the top revolution sensor 67*a* when the first top pinch-roller 53*a* makes K full revolutions.

For instance, when three magnets are equally spaced on the circumference of the first top pinch-roller 53*a*, if K=2, then six subsequent detections of these magnets by the top revolution sensor 67*a*, corresponding to two (K=2) full revolutions of the first top pinch-roller 53*a* and the instant diameter Da of the top storage-roller 50*a* can be estimated as follows:

$$Da=(2*Dg*R*N)/Ma$$

where

Ma is the measured number of steps of the top stepper motor 60*a* needed to cause the first top pinch-roller 53*a* to make 2 full revolutions (as detected by six subsequent detections of magnets by the top revolution sensor 67*a*).

A measurement on multiple full revolutions of the first top pinch-roller 53*a* is configured to determine:

- any mechanical run-out error of the first top pinch-roller 53*a,*
- magnets space accuracy,
- errors due to elastic transmission between motor and the top transport tape 52*a*, and
- numerical discretization error.

As every issuing operation or service operation can change the instant diameter of the top storage-roller 50*a* from the last estimated diameter of the top storage-roller 50*a*, a preset-procedure is needed to initialize diameter-measurements after each issuing-operation, power-on or service procedure.

The preset-procedure simulates a deposit without adding banknote, at first driving the top stepper motor 60*a* in receiving direction up to getting at least six revolution measurements of the top revolution sensor 67*a* to update the diameter of the top storage-roller 50*a* and then driving the top feeding motor 61*a* in issuing direction to return at original position for receiving banknote. After a preset-operation fill a measurements-buffer, even a single following measurement is averaged with the previous five measurements, regardless of the time spent between the operations.

Figure 8:
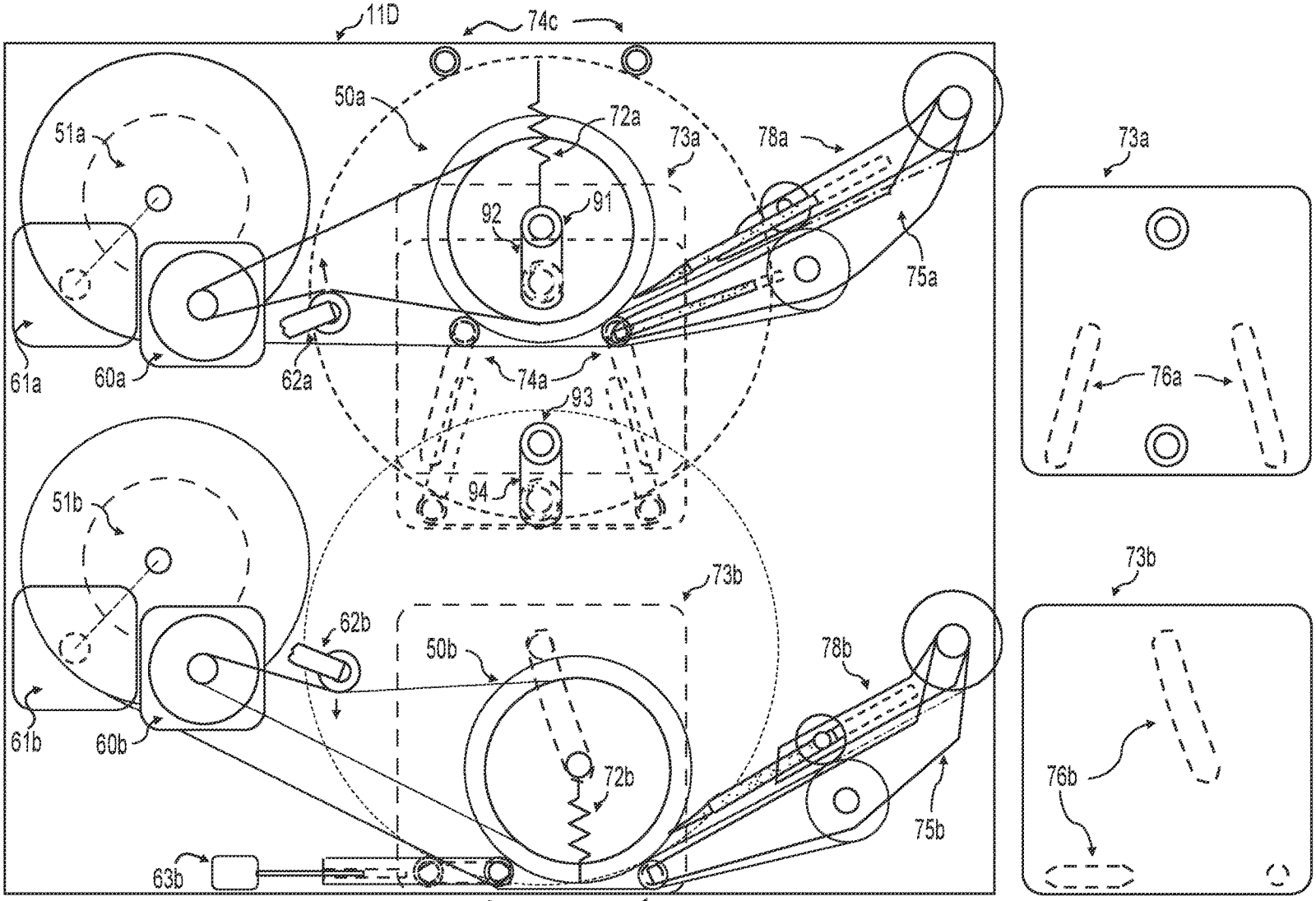
FIG. 8 shows a schematic view of another embodiment of the double storing and issuing module for banknotes or other flexible documents.

On the electronic unit 65, a memory buffer of the last six measurements for each revolution sensor 67*a* and 67*b* is updated at each new measurement and the microprocessor 80 calculates the diameters of both top and bottom storage-rollers 50*a* and 50*b* comparing both the single diameters and the sum of the two with a predefined threshold in order to set which one between the upper and lower sections of the double storing and issuing module 11A became full. One example for the embodiment shown in FIG. 8 is listed in Table 1.

TABLE 1

| Test-condition | Result (status) |
|---|---|
| Da ≥ 115.0 mm | A_Full |
| Db ≥ 115.0 mm | B_Full |
| (Da + Db) ≥ 200.0 mm | A + B_Full |

With reference to FIG. 2, the main electronic control unit 19 of the receiving and dispensing device 13, upon receiving a full status on a communication-interface, stops sending banknotes to the full section of the double storing and issuing module 11A concerned, re-directing the related banknote to output-vane 16.

The embodiment of the double storing and issuing module shown in FIG. 1, wherein the top and bottom storage rollers

50*a* and 50*b* have fixed axes, the related pairs of top and bottom accompanying rollers allow to use completely the common space but not the space between the top storage roller 50*a* and the top surface of the double storing and issuing module 11A or between the bottom storage roller 50*b* and the bottom-surface of the double storing and issuing module 11A.

Figure 5:
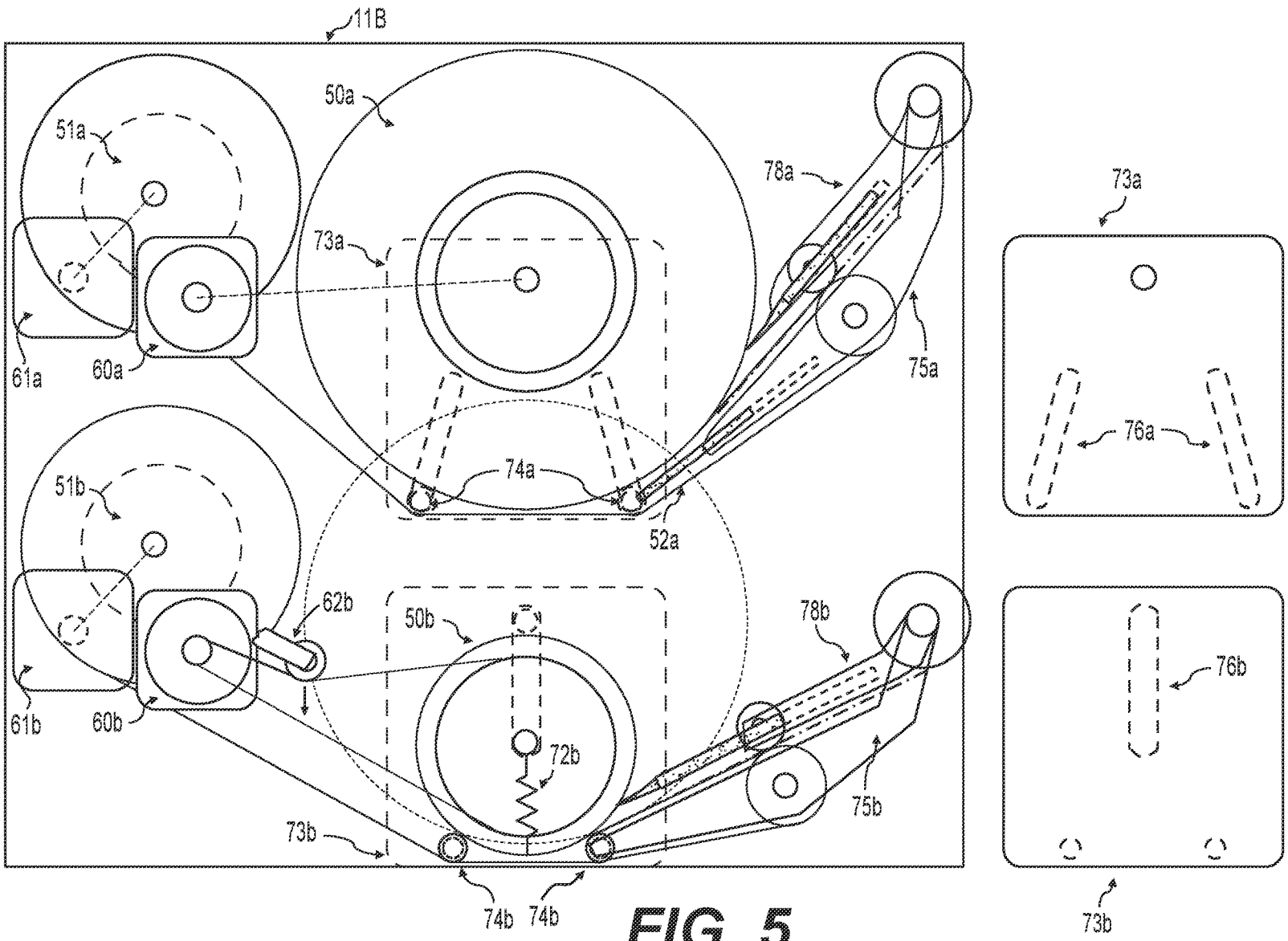
FIG. 5 shows a schematic view of another embodiment of the double storing and issuing module for banknotes or other flexible documents.

FIG. 5 shows another embodiment of the double storing and issuing module, indicated with the reference numeral 11B, wherein a different arrangement of the bottom storage roller 50*b* is used, wherein the bottom pair of accompanying rollers 74*b* are fixed at a distance from the bottom surface of the double storing and issuing module 11B to maintain a distance between the bottom tape forward path and the external surface of the bottom storage roller 50*b* greater than or equal to a third anti-friction gap and to maintain a fourth anti-friction gap between said bottom tape forward path and said bottom surface of the double storing and issuing module 11B. The axis of the bottom storage roller 50*b* has ends that can move vertically as a function of its own diameter guided by bottom side grooves 76*b* included in respective bottom side plates 73*b*, while a spring 72*b* assures contact with the bottom pair of accompanying rollers 74*b* during winding/unwinding of the bottom transport tape 52*b*.

Figure 6:
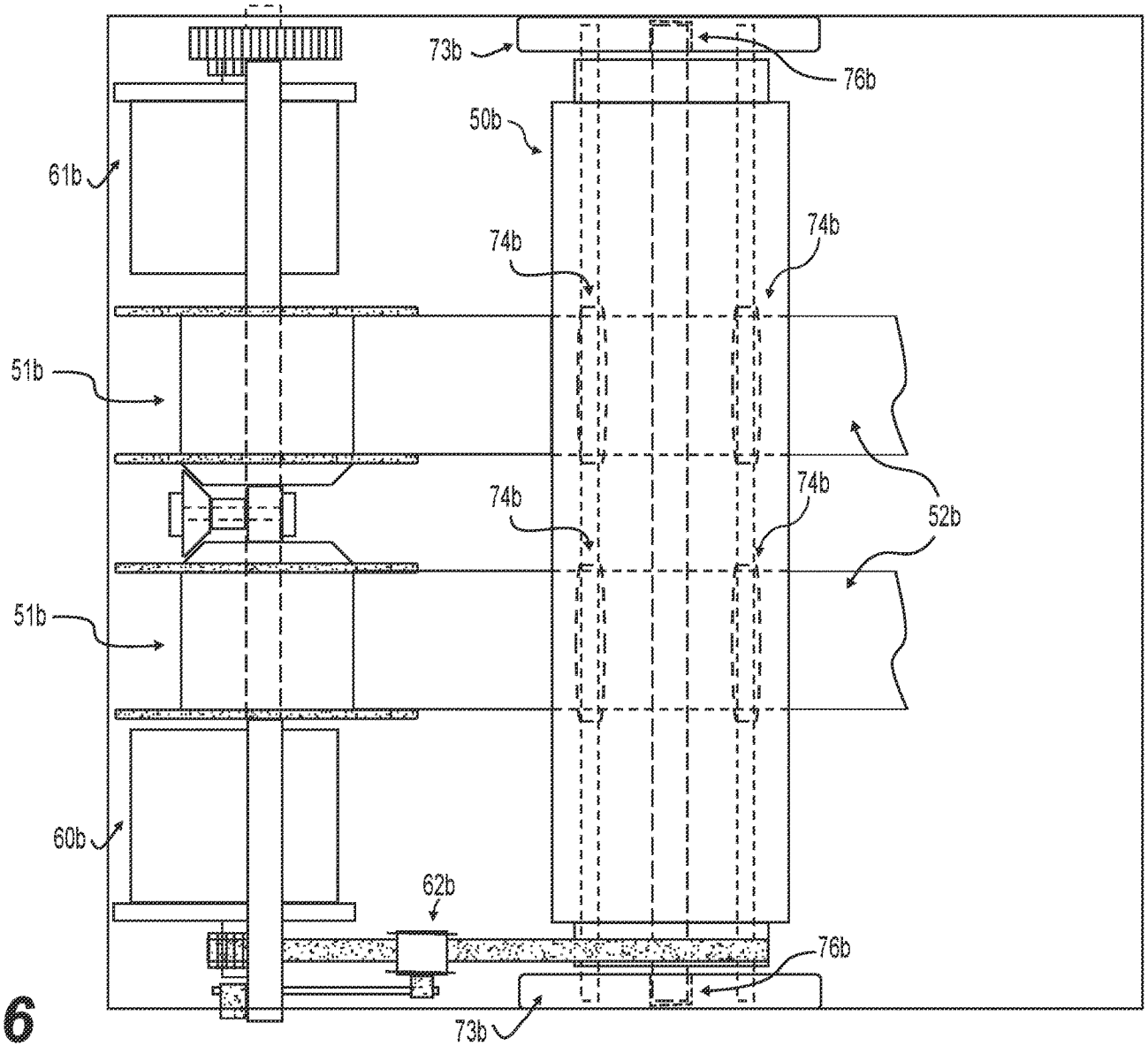
FIG. 6 shows a top plan view of the bottom section of the double storing and issuing module of FIG. 5.

FIG. 6 show the top plan view of the double storing and issuing module 11B shown in FIG. 5, including a double bottom transport tape 52*b* adapted for large width banknotes, showing the axes of the bottom storage roller 50*b* and of the bottom pairs of accompanying rollers 74*b* with bottom side plates 73*b* and the tensioner 62*b*, for the belt of the bottom stepper motor 60*b*, allowing a pulley position change for the bottom storage roller 50*b*.

Figure 7:
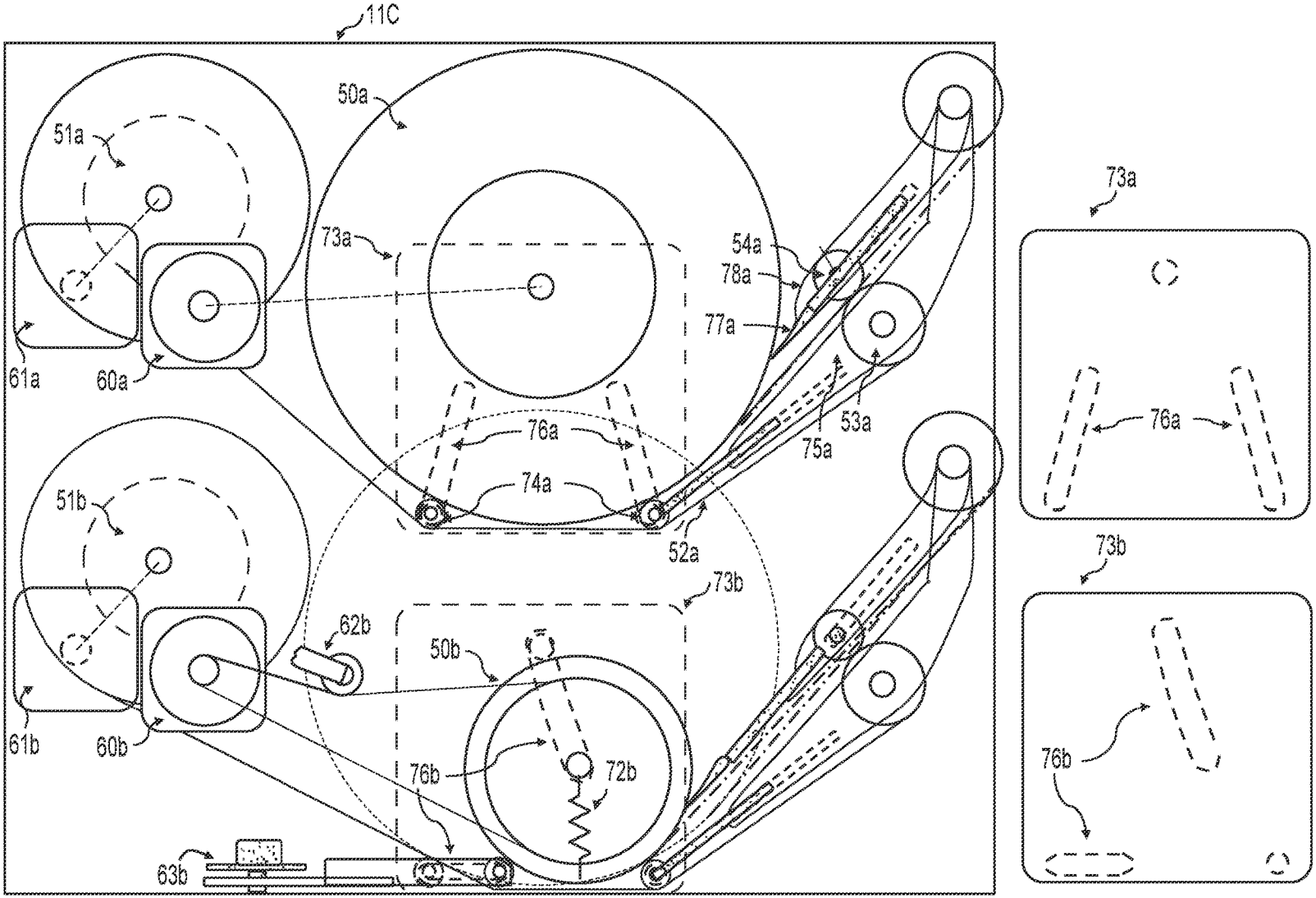
FIG. 7 shows a schematic view of another embodiment of the double storing and issuing module for banknotes or other flexible documents.

In order not to lose any millimeters in space and instead to assure at least a minimal gap as in the second embodiment shown in FIG. 5 in the bottom section, another embodiment of the double storing and issuing module, indicated with the reference numeral 11C, is shown in FIG. 7. The double storing and issuing module 11C includes a positioning actuator 63*b*, optionally implemented through a rack and pinion mechanism (or alternatively through a worm screw), configured to move one of the two bottom accompanying rollers 74*b* so as to maintain a constant minimal third anti-friction gap between the bottom tape forward path and the external surface of the bottom storage roller 50*b*. In the double storing and issuing module 11C, the reciprocal distance between the bottom pair of accompanying rollers 74*b* is adjusted by the positioning actuator 63*b* depending on the instant diameter of the bottom storage-roller 50*b*.

Using the trigonometric relation as shown in FIG. 3, when one of the bottom pair of accompanying rollers 74*b* has the axis position fixed (in FIG. 7 this is the right-hand one), by measuring the diameter of the bottom storage roller 50*b*, the microprocessor 80 can operate the positioning actuator 63*b* to set the distance between the bottom pair of accompanying rollers 74*b* equal to $2*x_{(D)}$; the ends of the axis of the bottom storage-roller 50*b* will consequently follow the predetermined side groove 76*b* trajectory on both side plate 73*b*.

In the embodiment of the double storing and issuing module shown in FIG. 7 (as well as in the embodiment of the double storing and issuing module shown in FIG. 8), the end of the lower lever arm 75*b* of the lower section may also be not extendable.

In order to fill also the space between top storage roller 50*a* and the top-surface of the double storing and issuing module, another embodiment of the double storing and issuing module, indicated with the reference numeral 11D, is shown in FIG. 8, wherein the upper section is provided with the composite action of two top pairs of accompanying rollers 74*a* and 74*c*, while in the bottom section the axis of the bottom storage roller 50*b* rises when the diameter thereof increases while the bottom accompanying rollers 74*b* distance is adjusted on the basis of the instant diameter of the bottom storage roller 50*a* by means of a positioning actuator 63*b*, optionally implemented through a worm screw (or alternatively through a rack and pinion mechanism).

Figure 9:
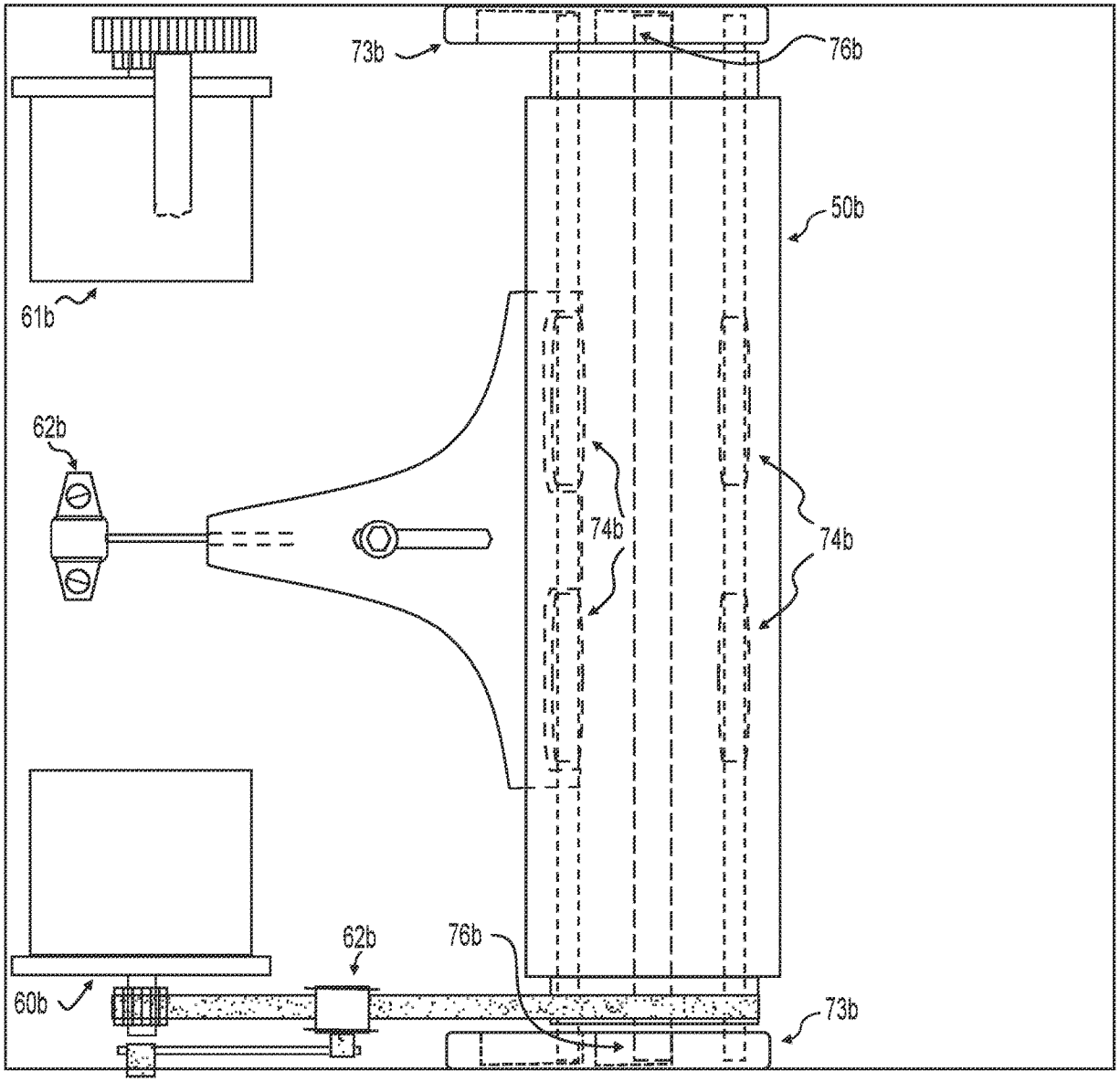
FIG. 9 is a top plan view of the bottom section of the double storing and issuing module of FIG. 8.

FIG. 9 shows the top plan view of the double storing and issuing module 11D shown in FIG. 8, including a double bottom transport tape 52*b* adapted for large width banknotes, showing the axes of the bottom storage roller 50*b* and of the bottom pairs of accompanying rollers 74*b* with bottom side plates 73*b* and the tensioner 62*b*, for the belt of the bottom stepper motor 60*b*, allowing a pulley position change for the bottom storage roller 50*b*. In this case, each of the top side plates 73*a* has, in addition to the side groove 76*a* (on the internal face), a main collar 91 receiving a corresponding end of the axis of the top storage roller 50*a* and that is configured to slide along a corresponding main side slot 92 of the double storing and issuing module 11D, wherein the corresponding main side slot 92 extends orthogonally to the top surface of the double storing and issuing module 11D. Each of the top side plates 73*a* is also provided with an alignment collar 93 that is configured to slide along a corresponding alignment side slot 94 of the double storing and issuing module 11D, wherein the corresponding alignment side slot 94 extends orthogonally to said top surface of the double storing and issuing module 11D. Two top side springs 72*a* push upward the top side plates 73*a* and consequently the axis of the top storage roller 50*a*. For instance in the double storing and issuing module 11D, when the instant diameter of the top storage roller 50*a* ranges from Dmin to 85 mm, then the external surface of the top storage roller 50*a* does not touch the additional top pair of accompanying rollers 74*c*, and only the first top pair of accompanying rollers 74*a* follows, in the top side grooves 76*a* of the top side plate 73*a*, the change of the instant diameter of the top storage roller 50*a*. When the instant diameter of the top storage roller 50*a* ranges from 85 mm to Dmax, then the external surface of the top storage roller 50*a* is also in contact with the additional top pair of accompanying rollers 74*c* which push down the top storage roller 50*a* and, consequently, the axis thereof, that is inserted into the main collars 91 of the top side plates 73*a* that moves vertically downwards as two main collars 91 of side plates 73*a* slide along the two corresponding main side slots 92 of the double storing and issuing module 11D, wherein the alignment collars 93 of the top side plates 73*a* slide along the two corresponding alignment side slots 94 of the double storing and issuing module 11D thus maintaining a vertical alignment of the top side plates 73*a*.

The preferred embodiments of this invention have been described and a number of variations have been suggested hereinbefore, but it should be understood that those skilled in the art can make other variations and changes without so departing from the scope of protection thereof, as defined by the attached claims. By way of example, embodiments of the double storing and issuing modules described herein may be configured as a multiple storing and issuing module for use with more than two different types of banknotes.

That which is claimed:

1. A multiple storing and issuing module comprising:

a first storage roller configured to store a first type of flexible document and a second storage roller configured to store a second type of flexible document, each storage roller having a sensor for monitoring a storage capacity of the storage roller;

a common space within the module shared by the first and second storage rollers for storing flexible documents; and an electronic unit with a memory storage and microprocessor, the electronic unit configured to maintain a minimum gap between the storage rollers, wherein the storage capacities of each storage roller have an adjustable maximum capacity based on maintaining a gap between the storage rollers greater than or equal to the minimum gap.

2. The multiple storing and issuing module of claim 1, wherein the first type and second type of flexible documents are banknotes of a first denomination and a second denomination.

3. The multiple storing and issuing module of claim 1, wherein the first storage roller and the second storage roller are substantially vertically arranged within the common space.

4. The multiple storing and issuing module of claim 1, wherein each storage roller includes a motor configured to rotate the storage roller, at least one transport tape configured to wrap the flexible document onto or off the transport tape and a feeding roller configured to wind the transport tape in a desired direction.

5. The multiple storing and issuing module of claim 4 further including a set of pinch rollers for each storage roller configured to engage and disengage the flexible document with the storage roller and an electromagnet for each set of pinch rollers configured to determine a pressure between the pinch rollers for engagement and disengagement with the storage roller, wherein the pinch rollers press onto transport tape and the storage roller at an increased pressure for engagement and wherein the pinch rollers release from the transport tape and the storage roller for disengagement.

6. The multiple storing and issuing module of claim 5, wherein the sensor is a revolution sensor configured to monitor storage capacity by relating each revolution of one of the pinch rollers to a storage roller revolution angle, wherein the revolutions are correlated to an amount of flexible documents stored on the storage roller.

7. The multiple storing and issuing module of claim 5, wherein each storage roller includes a pair of companion rollers, whereby at least one of the pair of companion rollers is configured to follow a trajectory along one or more side grooves for maintaining the minimum gap.

8. The multiple storing and issuing module of claim 7, wherein at least one of the storage rollers is configured to move along one or more collars on a side plate.

9. The multiple storing and issuing module of claim 8, wherein the pair of companion rollers for one of the storage rollers are installed in a fixed position on the side plate.

10. The multiple storing and issuing module of claim 8 further including a spring to connect the pair of rollers in the fixed position with its storage roller.

11. The multiple storing and issuing module of claim 8 further including a belt tensioner pulley assembly.

12. The multiple storing and issuing module of claim 8 further including one or more additional actuators configured to maintain spacing between the storage rollers and a surface of the storing and issuing module.

13. The multiple storing and issuing module of claim 7 further including a set of accompanying rollers outside the common space for each storage roller positioned at a maximum distance that the storage rollers can travel outside the common space and configured to prevent the storage roller from traveling past the maximum distance.

14. The multiple storing and issuing module of claim 7, wherein the minimum gap is determined by a diameter defined as a distance between a center of the storage roller and the companion rollers.

15. The multiple storing and issuing module of claim 7 further including an upper lever arm with an actuatable pinch roller and configured to facilitate separation of the banknote from the transport tape, and a lower lever arm with one of the companion rollers at an end of the lower lever arm, the lower lever arm configured to guide the banknotes between the storage roller and the diverter.

16. A banknote receiving and dispensing device with storage rollers each having an adjustable maximum capacity for storing banknotes, the receiving and dispensing device comprising:

an upper body assembly for receiving and dispensing banknotes, and a lower body assembly for storing banknotes, the lower body assembly comprising a safe having a plurality of lodgements and a transport mechanism for storing and issuing banknotes, wherein one or more of the lodgements each include a double storing and issuing module, wherein the double storing and issuing module comprises a first storage roller configured to store a first denomination of a banknote and a second storage roller configured to store a second denomination of a banknote, each storage roller having a sensor for monitoring a storage capacity of the storage roller, a common space within the module shared by the first and second storage rollers for storing banknotes, an electronic unit with a memory storage and microprocessor, the electronic unit configured to maintain a minimum gap between the storage rollers, and wherein the storage capacities of each storage roller have an adjustable maximum capacity based on maintaining a gap between the storage rollers greater than or equal to the minimum gap.

17. The receiving and dispensing device of claim 16, wherein each storage roller includes a motor configured to rotate the storage roller, at least one transport tape configured to wrap the flexible document onto or off the storage roller and a feeding roller configured to wind the at least one transport tape in a desired direction.

18. The receiving and dispensing device of claim 17 further including a set of pinch rollers for each storage roller configured to engage and disengage the banknote with the storage roller and an electromagnet for each set of pinch rollers configured to determine a pressure between the pinch rollers for engagement and disengagement with the storage roller, wherein the pinch rollers press onto transport tape and the storage roller at an increased pressure for engagement and wherein the pinch rollers release from the transport tape and the storage roller for disengagement.

19. The receiving and dispensing device of claim 18, wherein each storage roller includes a pair of companion rollers configured to follow a trajectory for maintaining the minimum gap.

20. The receiving and dispensing device of claim 19, wherein the sensor is a revolution sensor configured to monitor storage capacity by relating each revolution of one of the pinch rollers to a storage roller revolution angle, wherein the revolutions are correlated to an amount of flexible documents stored on the storage roller.

21. The receiving and dispensing device of claim 19 further including a plurality of diverters configured to distribute banknotes to the storage roller based on a denomination of the banknote and an electromagnet for each diverter configured to actuate the diverter and enable the banknote to enter or exit a path of the storage roller.

22. The receiving and dispensing device of claim 21 further including an upper lever arm with an actuatable pinch roller and configured to facilitate separation of the banknote from the transport tape, and a lower lever arm with one of the companion rollers at an end of the lower lever arm, the lower lever arm configured to guide the banknotes between the storage roller and the diverter.

23. The receiving and dispensing device of claim 21 further including a photoelectric sensor configured to detect the presence of the banknote entering from the diverter.

24. The receiving and dispensing device of claim 23, wherein the electronic unit is configured to manage the entry and exit of banknotes onto and off the storage rollers by controlling the activation of the motors, the electromagnets of the pinch rollers and the electromagnets of the diverters.

25. The receiving and dispensing device of claim 16 further including a recognition unit configured to determine a denomination of banknotes entering the input vane.

26. The receiving and dispensing device of claim 25 further including a capture bin configured to store undeliverable banknotes.

27. The receiving and dispensing device of claim 26 further including an electronic control unit in communication with the electronic unit and configured to assign banknotes to a storage roller or the capture bin.

28. The receiving and dispensing device of claim 16 further including an input vane configured to receive banknotes and an output vane configured to dispense banknotes.

29. A method for managing storage capacities for a first storage roller and a second storage roller sharing a common space within a storing and issuing module, the method comprising adjusting a storage capacity of the first storage roller and a storage capacity of the second storage roller in real-time while maintaining at least a minimum gap between the first storage roller and the second storage roller and monitoring a diameter of a first storage roller and a diameter of a second storage roller to ensure that the minimum gap is maintained.

30. The method of claim 29 further including the steps of identifying a denomination of a banknote received and assigning a storage roller to store the banknote based on its denomination.

31. The method of claim 30, wherein the storage capacities are adjusted in real-time based on a number of banknotes and a number of denominations corresponding to the banknotes received.

32. The method of claim 31, wherein the storage capacities are adjusted by an electronic unit having a microprocessor and a memory storage device.

33. The method of claim 29, wherein the first storage roller and the second storage roller are substantially vertically adjacent within the common space.

* * * * *